US006027345A

United States Patent [19]

McHugh et al.

[11] Patent Number: 6,027,345

[45] Date of Patent: Feb. 22, 2000

[54] MATRIX-TYPE ELECTRICAL CONNECTOR

[75] Inventors: Robert G. McHugh, Evergreen, Colo.; William B. Walkup, Hillsboro, Oreg.; Spencer Lai, Hsin-Chuang, Taiwan

[73] Assignee: Hon Hai Precision Ind. Co., Ltd., Taipei Hsien, Taiwan

[21] Appl. No.: 09/036,483

[22] Filed: Mar. 6, 1998

[51] Int. Cl.[7] ..... H01R 9/09

[52] U.S. Cl. ..... 439/66; 439/74; 439/608

[58] Field of Search ..... 439/66, 74, 608, 439/540.1

[56] References Cited

U.S. PATENT DOCUMENTS

| | | | |
|---|---|---|---|
| 4,582,386 | 4/1986 | Martens | 439/631 |
| 5,380,210 | 1/1995 | Grabbe et al. | 439/66 |
| 5,527,189 | 6/1996 | Middlehurst et al. | 439/608 |
| 5,575,686 | 11/1996 | Noschese | 439/74 |
| 5,620,340 | 4/1997 | Andrews | 439/608 |
| 5,743,765 | 4/1998 | Andrews et al. | 439/608 |
| 5,775,947 | 7/1998 | Suzuki et al. | 439/608 |
| 5,803,768 | 9/1998 | Zell et al. | 439/608 |

*Primary Examiner*—Renee S. Luebke
*Assistant Examiner*—T. C. Patel

[57] ABSTRACT

A matrix-type board-to-board electrical connector for horizontally and electrically engaging a daughter board with a mother board includes an insulative housing having a top surface and a bottom surface and defining a plurality of first and second passageways therethrough. Each first passageway receives a C-shaped resilient signal contact therein for transmitting high or low frequency signals. Each second passageway receives a substantially triangular shaped resilient power contact for carrying a large power current. The first passageways receiving the contacts which transmit high frequency signals either have a circular recess defined therearound for receiving a corresponding cylindrical shielding shell or are located between shielded first passageways thereby providing all of the contacts which transmit high frequency signals with shielding properties. The passageways are defined in the housing of the connector so that the contacts serving the same function are disposed in the same general area of the connector.

13 Claims, 7 Drawing Sheets

MATRIX-TYPE ELECTRICAL CONNECTOR

BACKGROUND OF THE INVENTION

1. Field of the Invention

The present invention relates to an electrical connector, and more particularly to a board-to-board matrix-type electrical connector for transmitting both low and high frequency signals as well as large power currents between a mother board and a corresponding daughter board.

2. The Prior Art

The expansion of a computer's memory and capability is often achieved through the addition of expansion cards (also referred to as daughter boards) electrically connected to a mother board of the computer. The daughter board can be connected to the mother board by means of a vertical card connector which has one surface mounted to the mother board and receives an edge of the daughter board in a slot defined in another surface thereof so that the daughter board is positioned perpendicular to the mother board when electrically engaged therewith. Alternatively, a horizontal card connector can be used to parallel the two printed circuit boards thereby promoting a more efficient use of space.

Alternatively, another approach is so-called board-to-board connector assembly which commonly consists of a plug connector portion mounted to a bottom surface of the daughter board and a receptacle connector portion mounted on a top surface of the mother board using well-known surface mounting techniques. The plug and receptacle connector portions are then mated together for transmitting signals between the two printed circuit boards. Since the conventional board-to-board connector requires soldering of each connector portion onto a corresponding printed circuit board before the portions are mated together, manufacture and assembly thereof becomes laborious as well as time and cost inefficient. Furthermore, such a mated connector may result in poor transmission of high frequency signals.

Moreover, conventional connectors also require the positioning of grounding pins between signal pins for reducing ground bounce and cross talk therebetween during high speed signal transmission, thus increasing the total number of pins and the corresponding space. In addition, such a conventional connector does not provide the daughter board with access to a power supply, rather, power cables connect the daughter board with the power supply via the mother board further complicating the assembly thereof. Therefore, an improved connector is required which can overcome the drawbacks of the prior art connectors.

SUMMARY OF THE INVENTION

An objective of the present invention is to provide a matrix-type electrical connector for horizontally and electrically engaging a daughter board with a mother board which is easy to manufacture and assemble without requiring soldering.

Another objective of the present invention is to provide a matrix-type electrical connector having a plurality of resilient signal contacts for transmitting high and low frequency signals and a plurality of resilient power contacts for carrying large power currents.

A further objective of the present invention is to provide a matrix-type electrical connector with a plurality of cylindrical shielding shells for shielding all of the high frequency signal contacts thereby reducing ground bounds and cross talk therebetween.

Yet another objective of the present invention is to provide an electrical connector having an anti-disorientation and fastening means for ensuring that the connector is properly and securely sandwiched between the two printed circuit boards.

In accordance with one aspect of the present invention, a matrix-type electrical connector for horizontally and electrically engaging a daughter board with a mother board includes an insulative housing having a top surface and a bottom surface and defining a plurality of first and second passageways therethrough.

Each first passageway receives a resilient signal contact therein for transmitting either high or low frequency signals. Each second passageway receives a substantially triangular shaped resilient power contact therein for carrying a large current from a power supply. Each contact has portions thereof respectively projecting beyond the top and bottom surfaces of the connector for electrically connecting flat contact pads formed on a bottom surface of the daughter board with corresponding flat contact pads formed on a top surface of the mother board. The passageways are defined in the housing of the connector so that the contacts serving the same function are disposed in the same general area of the connector.

The first passageways receiving the high frequency signal contacts either have a circular recess defined therearound for receiving a corresponding cylindrical shielding shell or are surrounded by shielded first passageways, therefore, all of the contacts which transmit high frequency signals are provided with shielding properties.

The connector also includes an anti-disorientation and fastening means for ensuring that the connector is properly and securely sandwiched between the daughter board and the mother board.

DETAILED DESCRIPTION OF THE PREFERRED EMBODIMENT

Figure 1:
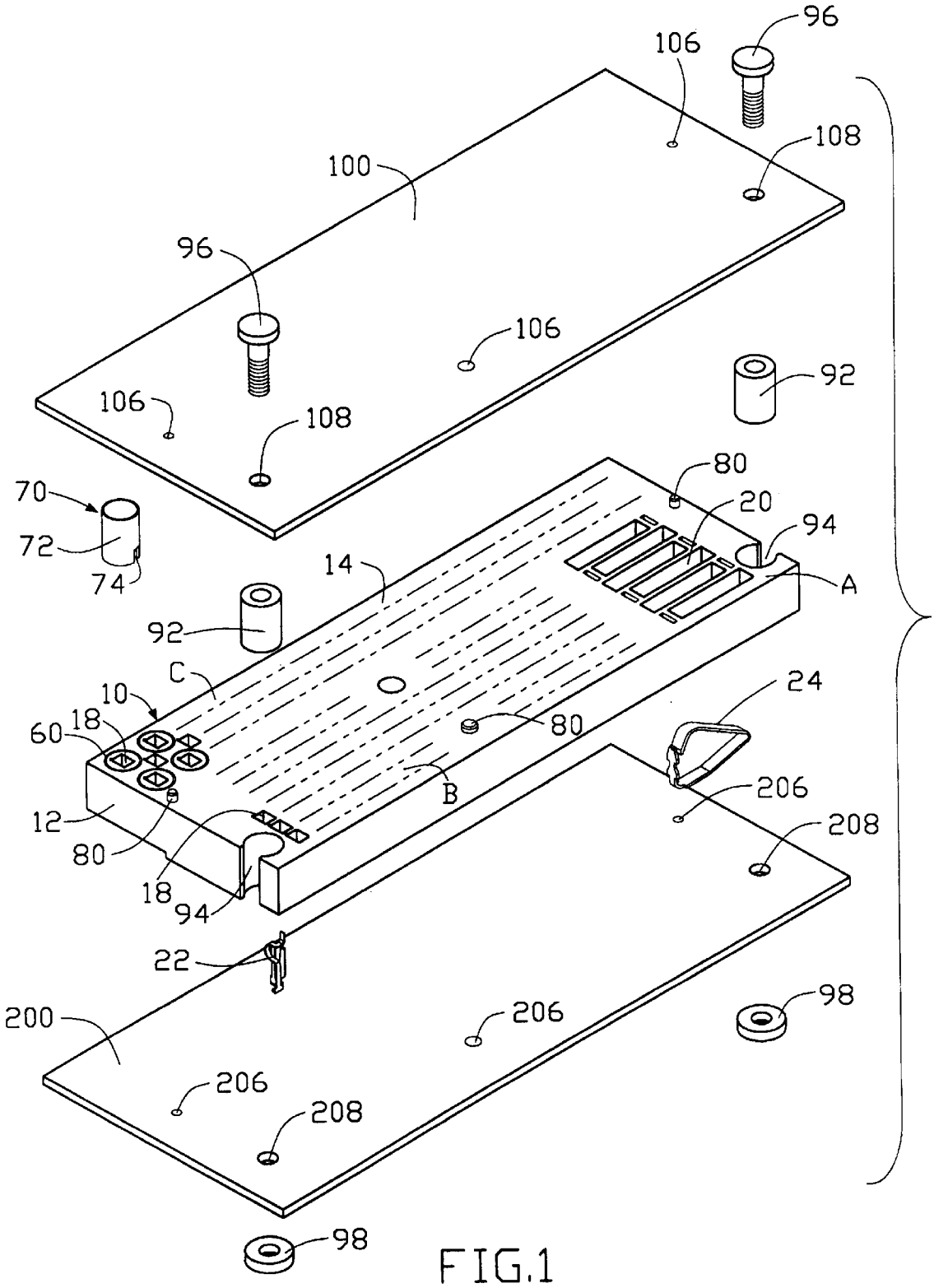
FIG. 1 is an exploded perspective view of a presently preferred embodiment of a matrix-type electrical connector assembly, according to the invention.
Figure 2:
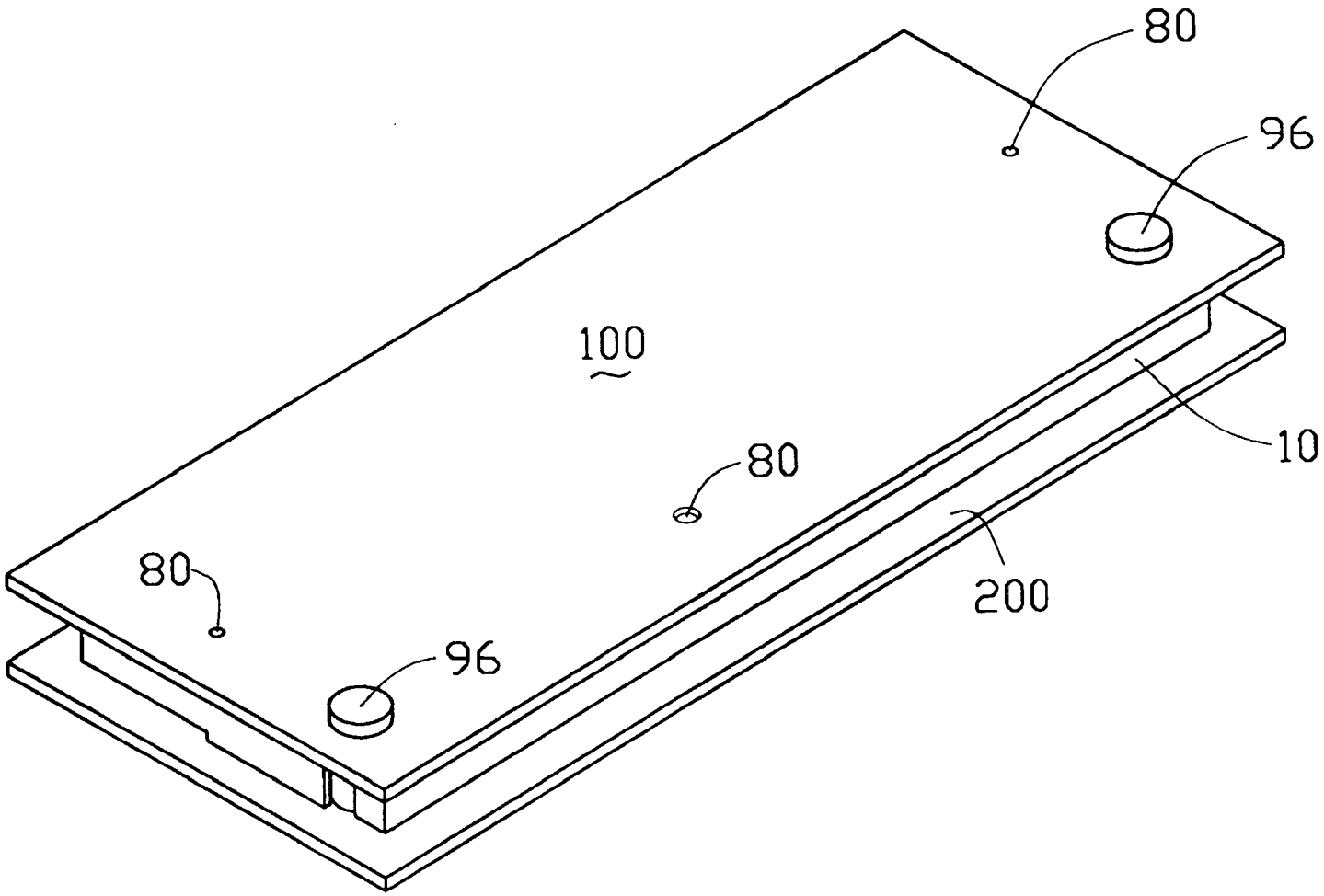
FIG. 2 is a perspective view of the assembled electrical connector assembly of FIG. 1.
Figure 3:
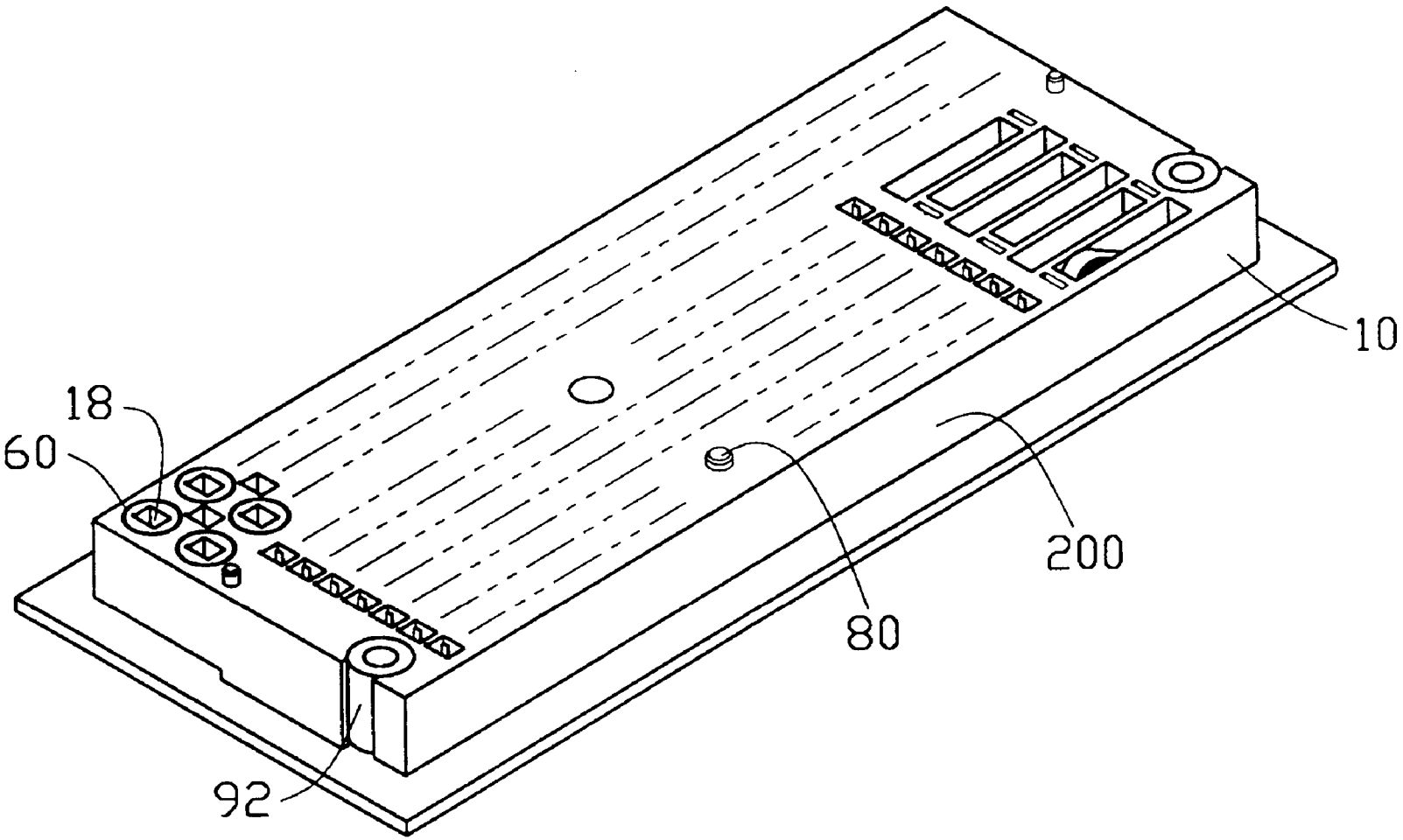
FIG. 3 is a perspective view of the semi-assembled connector assembly of FIG. 1 to show how the connector is mounted on the mother board.

Referring to FIGS. 1–7, an electrical connector 10 for horizontally and electrically engaging a daughter board 100 with a mother board 200 in accordance with the present invention includes an insulative housing 12 having a top surface 14 and a bottom surface 16 and defining a plurality of first passageways 18 and second passageways 20 therethrough for receiving a corresponding plurality of signal contacts 22 and power contacts 24 therein, respectively. An upper engagement portion 26 of each of the power contacts 24 projects beyond the top surface 14 of the connector 10 for respectively engaging with a flat contact pad 102 formed on a bottom surface 104 of the daughter board 100, and a lower engagement portion 28 of each of the power contacts 24 projects beyond the bottom surface 16 of the connector 10 for respectively engaging with a flat contact pad 202 formed on a top surface 204 of the mother board 200.

The signal contacts 22 are C-shaped resilient contacts used for transmitting high and low frequency signals. Each signal contact includes a main body 30, a retaining portion 32 projecting upward from a lower portion 34 of the main body 30, a C-shaped resilient beam 36 projecting upward from an opposite lower portion 38 of the main body 30, an upper engagement portion 40 extending upward from a free end 42 of the beam 36, and a lower engagement portion 44 extending downward from the main body 30 of the contact 22.

The power contacts 24 are substantially triangular shaped contacts used for carrying large currents from a power supply. Each power contact has a V-shaped main body 46 with a curved ending 48 extending inward from one free end thereof and a retaining portion 50 extending toward the curved portion 48 from another free end thereof. Each retaining portion 50 has two barbs 52 formed on each side thereof. Each second passageway 20 includes a retaining aperture 54 for receiving the retaining portion 50 of the power contact 24 and an elongate slot 56 for receiving the main body 46 of the power contact 24 wherein the aperture 54 and the slot 56 are partially separated from each other by a partition wall 58.

The passageways 18 are defined in predetermined locations of the housing 12 of the connector 10 whereby the signal contacts 22 serving the same function are disposed in the same general area of the connector 10. The first passageways 18 receiving the high frequency signal contacts 22 are defined in three rows along a length of the connector 10 near an edge thereof. The passageways 18 defined in the outlying rows each has a tubular recess 60 defined therearound for receiving a corresponding cylindrical shielding shell 70. The passageways 18 defined in the center row are each surrounded by four shielded passageways 18 of the outlying rows, therefore, all of the signal contacts 22 which transmit high frequency signals are provided with shielding properties.

Figure 4:
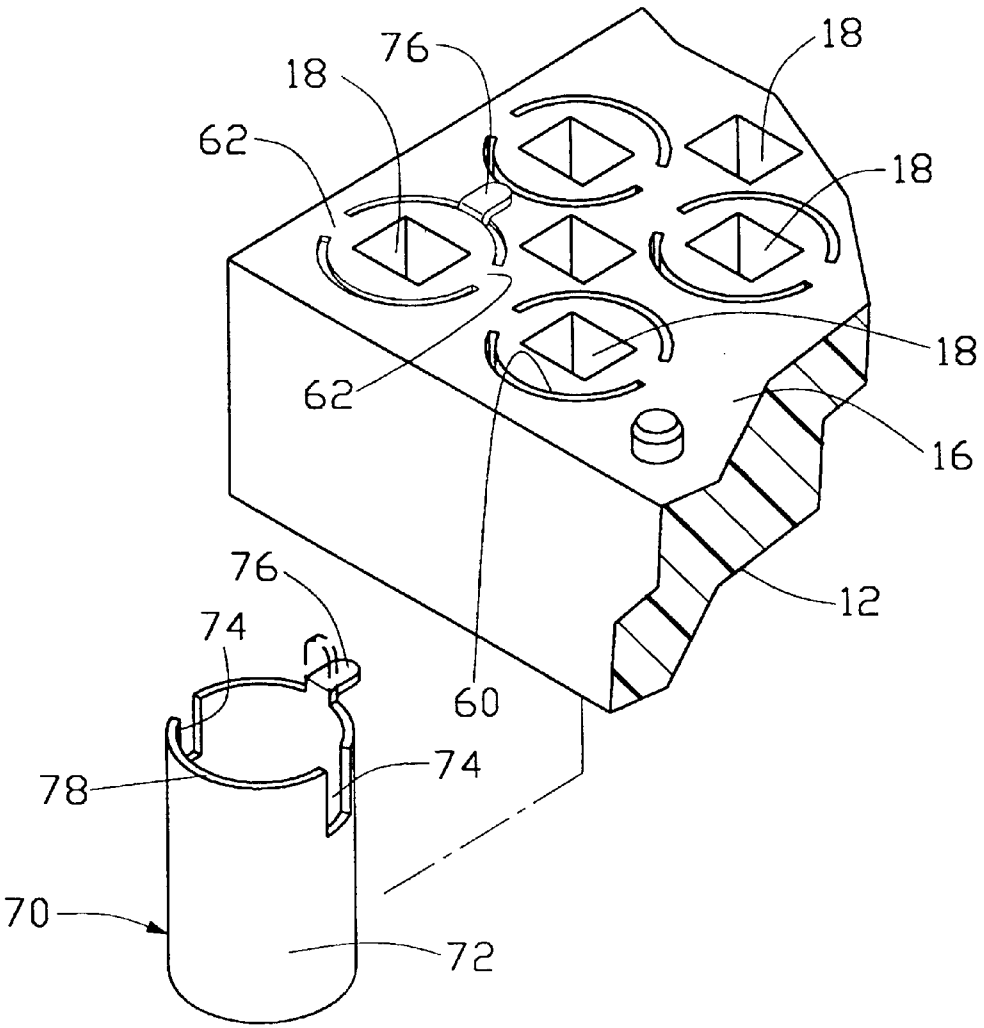
FIG. 4 is a partially enlarged perspective view of the upside-down connector of FIG. 1 to show how the shielded shell is received within the corresponding recess of the housing.
Figure 5:
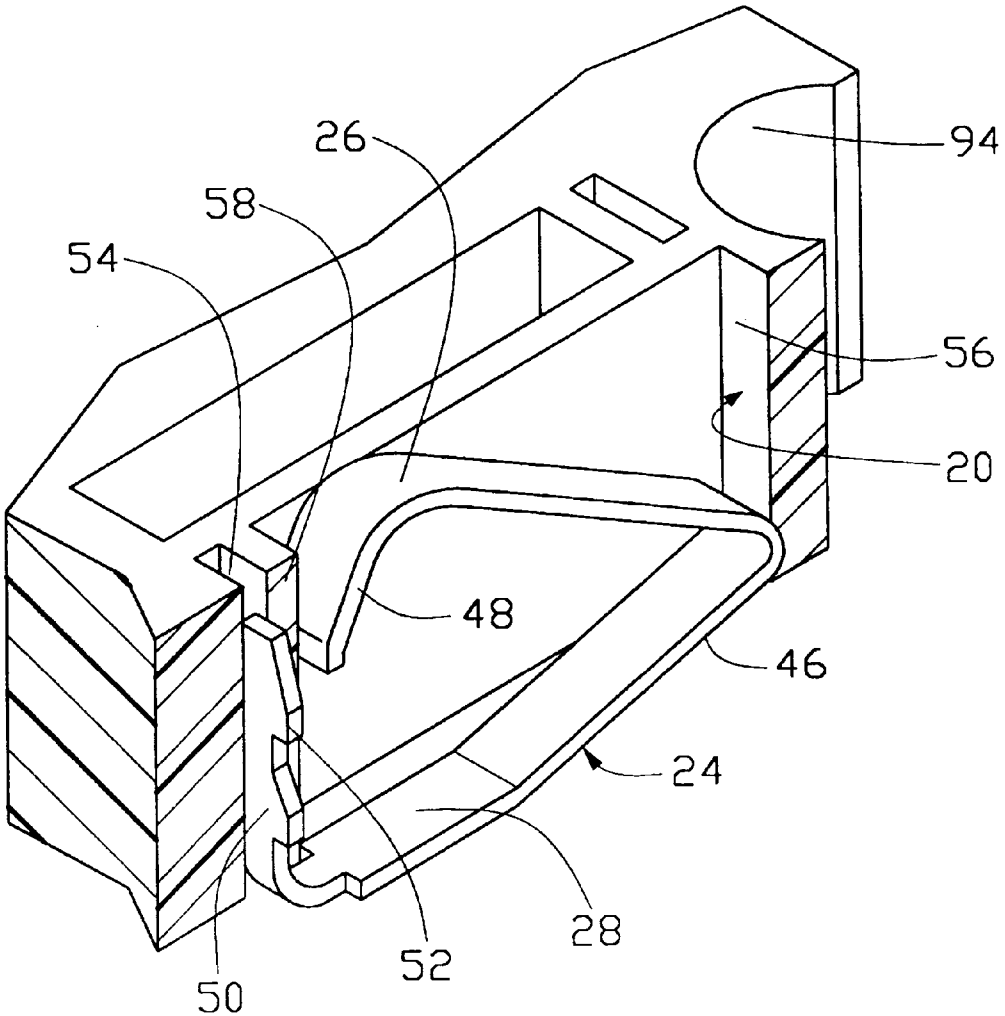
FIG. 5 is a fragmentary enlarged perspective view of the connector to show how the power contact is received within the corresponding passageway.
Figure 6:
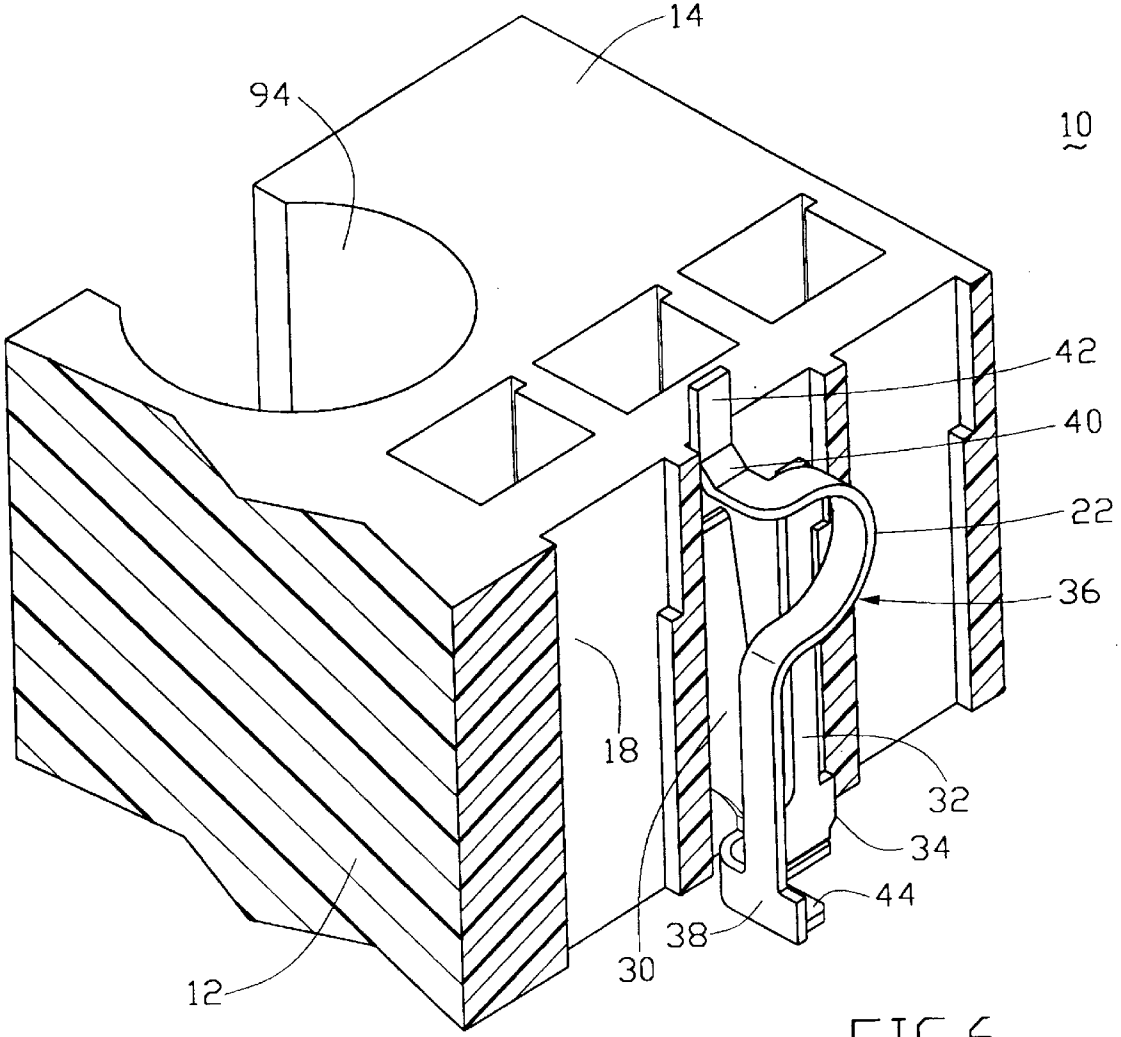
FIG. 6 is a fragmentary enlarged perspective view of the connector to show how the signal contact is received within the corresponding passageway.
Figure 7:
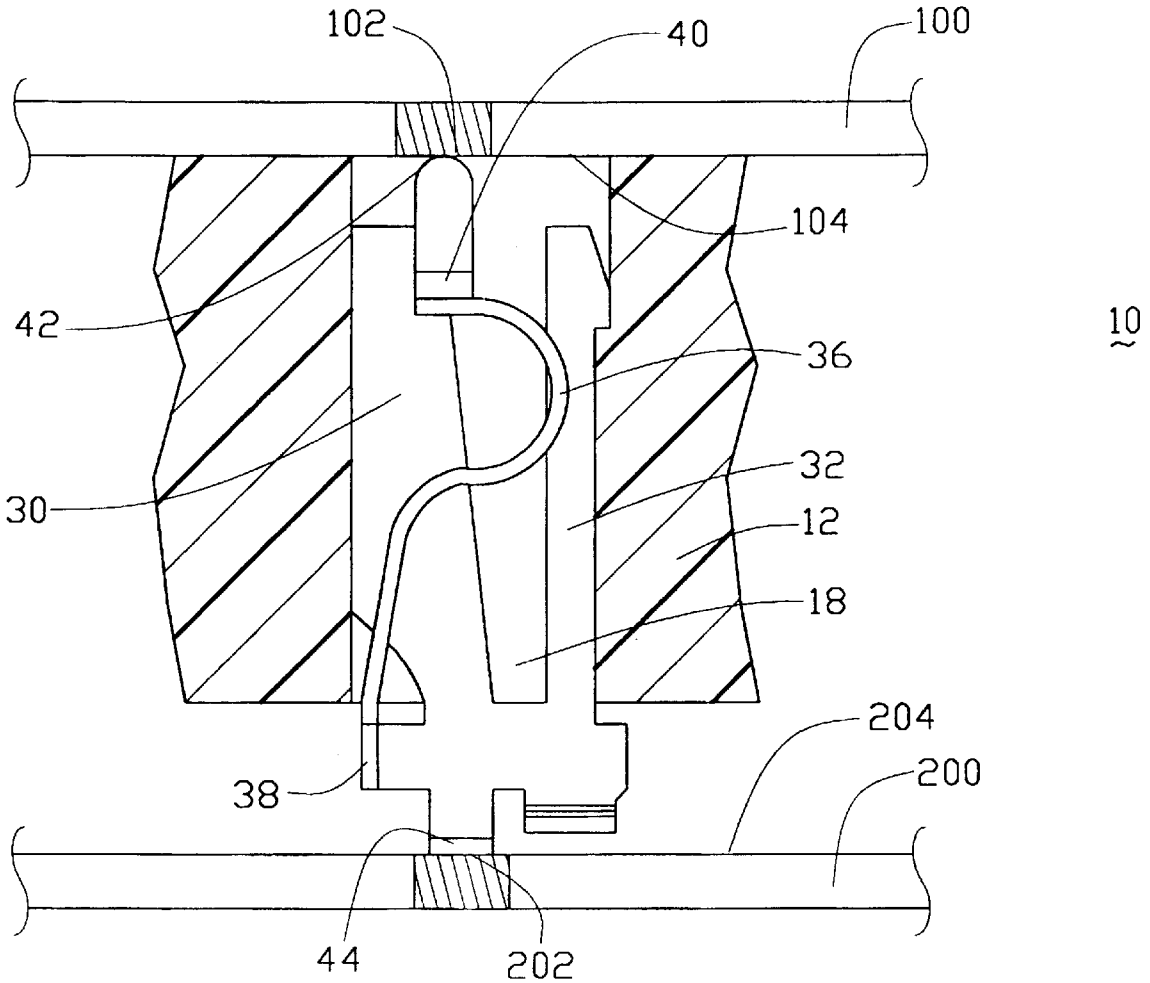
FIG. 7 is a partial enlarged cross-sectional view of the connector to show how the signal contact is received within the corresponding passageway.

Referring to FIG. 4, each cylindrical shielding shell 70 includes a cylinder main body 72 with a pair of diametrically opposite slots 74 extending along the axis. Correspondingly, the housing 12 includes a pair of diametrically opposite connection shoulders 62 in each corresponding recess 60 so as to be engagably received within the corresponding slots 74 when the shell 70 is fully inserted into the corresponding recess 60 from the top. Afterwards, a fastening tag 76 originally integrally downward extending from the bottom edge 78 of the shell 70 as shown in broken lines in FIG. 4, is bent horizontally. Therefore, the shell 70 can be retained within the recess 60 without movement.

Three posts 80 are formed at predetermined positions on each of the top and bottom surfaces 14, 16 of the connector 10 which correspond with three holes 206, 106 defined in each daughter board 100 and mother board 200 thereby providing the connector 10 with an anti-disorientation means for ensuring that the connector 10 is properly sandwiched between the daughter board 100 and the mother board 200.

A pair of fastening devices 90 for securing the connector 10 between the two printed circuit boards 100, 200 each comprises a washer 92 positioned in the notch 94 of the connector 10 cooperates with a bolt 96 extending through a corresponding hole 108 of the daughter board 100 and another corresponding hole 208 of the mother board 200, wherein a nut 98 is attached to the distal end of the bolt 96.

The above description clearly discloses a matrix-type electrical connector 10 for horizontally and electrically engaging a daughter board 100 with a mother board 200 via contacts 22, 24 which transmit both low and high frequency signals therebetween and carry large power currents from a power supply. The disclosed electrical connector 10 is easy to manufacture and assemble without requiring surface mounting techniques for soldering. The connector 10 also provides each high frequency signal contact with improved shielding properties for reducing grounding bounce and cross talk therebetween. Therefore, the present invention provides a matrix-type electrical connector with an improved function and design, and should be granted a patent.

One feature of the invention is that the invention uses corresponding shielding shell 70 surrounding each signal contact 22 which is designed to be used for high frequency signal transmission instead of providing additional plural grounding contacts circumferentially adjacent to each such high frequency transmission contact in the prior art. Moreover, the signal contacts 22 of the center row passageways 18 of the three rows high frequency signal contacts 22 as aforementioned even require no shielding shell 70 because of each being surrounded by four shielding shell 70 aside. This results in efficient use of the space of the connector housing 12. It is also noted that the whole arrangement of the contacts 22, 24 on the connector housing 12 can be designed as a power contact region A constituted by six second passageways 20 and the corresponding power contacts 24 therein, a low speed signal contact region B, beside the region A in the lengthwise direction along the housing 12, constituted by seven rows of the first passageways 18 and the corresponding contacts 22 therein, and a high speed signal contact region C extending along the full length of the housing 12 and constituted by three rows of first passageways 18 wherein the two outermost rows of such passageways 18 each is surrounded by a shielding shell 70. This is also a novelty arrangement for completely solving the transmission requirements in one package.

While the present invention has been described with reference to a specific embodiment, the description is illustrative of the invention and is not to be construed as limiting the invention.

Therefore, various modifications to the present invention can be made to the preferred embodiment by those skilled in the art without departing from the true spirit and scope of the invention as defined by the appended claims.

We claim:

1. An electrical connector for electrically engaging a daughter board with a mother board comprising:

an insulative housing having a top surface and a bottom surface and defining a plurality of first passageways and second passageways therethrough;

a first contact received in each first passageway for transmitting signals between the daughter and the mother board, wherein a portion of the first contacts transmit high frequency signals and the remainder of the first contacts transmit low frequency signals;

a second contact received in each second passageway for carrying a large power current from a power supply to the daughter board; and a plurality of cylindrical shielding shells received in corresponding circular recesses defined around a portion of the first passageways receiving the first contacts which transmit high frequency signals for reducing grounding bounce and cross talk therebetween;

wherein the passageways are defined in the housing of the connector so that the contacts serving the same function are disposed in the same general area of the connector.

2. The connector as described in claim 1, wherein said connector further includes an orientation means for ensuring the correct orientation and proper alignment of the connector when the connector is sandwiched between the daughter board and the mother board.

3. The connector as described in claim 1, wherein said connector further includes fastening means for securely sandwiching the connector between the daughter board and the mother board.

4. The connector as described in claim 1, wherein each contact has an upper engagement portion projecting beyond the top surface of the connector for engaging with a corresponding contact pad of the daughter board and a lower engagement portion projecting beyond the bottom surface of the connector for engaging with a corresponding contact pad of the mother board.

5. The connector as described in claim 1, wherein the second contacts are resilient power contacts having a V-shaped main body with a curved ending extending inward from a free end thereof and a retaining portion extending toward the curved portion from another free end thereof.

6. The connector as described in claim 5, wherein each second passageway includes a retaining aperture for receiving the retaining portion of the second contact and an elongate slot for receiving the main body of the second contact.

7. The connector as described in claim 1, wherein each cylindrical shielding shell comprises a pair of diametrically opposite slots extending along a center axis thereof.

8. The connector as described in claim 1, wherein a portion of the first passageways which receive the first contacts for transmitting high frequency signals and do not have circular recesses defined therearound are positioned between the first passageways which do have circular recesses defined therearound with cylindrical shielding shells received therein, thereby providing all of the contacts which transmit high frequency signals with shielding properties.

9. An arrangement of a connector comprising:

an insulative housing defining a first region retaining a plurality of power contacts therein, a second region retaining a plurality of low frequency signal transmission contacts therein, and a third region retaining a plurality of high frequency signal transmission contacts therein, a portion of the high frequency signal transmission contacts being shielded by corresponding shielding shells under the condition that each of said high frequency signal transmission contacts is fully circumferentially surrounded by the corresponding one of said shielding shells.

10. The arrangement as described in claim 9, wherein the remainder of the high frequency signal transmission contacts are surrounded by said shielded high frequency signal transmission contacts.

11. The arrangement as described in claim 9, wherein the high frequency signal transmission contacts are like the low frequency signal transmission contacts while the power contacts are dimensioned larger than both the high frequency signal transmission contacts and the low frequency signal transmission contacts.

12. The arrangement as described in claim 9, wherein the first region together with the second region occupies a full lengthwise dimension of the housing while the third region also occupies the full lengthwise dimension of the housing.

13. An arrangement of a high frequency signal transmission connector comprising:

a plurality of high frequency signal transmission contacts arranged along more than one row; and a plurality of shielding shells provided for some of said contacts, each of said shielding shells fully circumferentially surrounding each corresponding one of said corresponding contacts in a one-to-one relation; wherein the remainder of said contacts, which are not surrounded respectively by the corresponding shielding shells, are substantially surrounded by said contacts which are respectively fully circumferentially surrounded by said shielding shells, so that every contact is provided with direct or indirect shielding.

* * * * *